US006374676B1

(12) United States Patent
Arnold et al.

(10) Patent No.: US 6,374,676 B1
(45) Date of Patent: Apr. 23, 2002

(54) ULTRASONIC TRANSDUCER

(75) Inventors: Herbert Arnold, Eberdingen; Dieter Karr, Tiefenbronn; Meike Fehse, Leonberg; Peter Rapps, Karlsruhe; Waldemar Ernst, Vaihingen/Enz, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/529,136

(22) PCT Filed: Oct. 5, 1998

(86) PCT No.: PCT/DE98/02938

§ 371 Date: Jun. 2, 2000

§ 102(e) Date: Jun. 2, 2000

(87) PCT Pub. No.: WO99/18563

PCT Pub. Date: Apr. 15, 1999

(30) Foreign Application Priority Data

Oct. 7, 1997 (DE) ..... 197 44 229

(51) Int. Cl.[7] ..... H04R 17/00; B06B 1/06

(52) U.S. Cl. ..... 73/632; 310/324; 310/334; 310/336

(58) Field of Search ..... 310/324, 326, 310/327, 334, 336, 348; 73/632, 649

(56) References Cited

U.S. PATENT DOCUMENTS

| | | | | |
|---|---|---|---|---|
| 3,890,423 A | * | 6/1975 | Zacharias, Jr. | 310/334 |
| 4,195,284 A | | 3/1980 | Hampshire et al. | 340/384 E |
| 4,228,379 A | * | 10/1980 | Guscott et al. | 310/322 |
| 4,918,990 A | * | 4/1990 | Fowler et al. | 73/629 |
| 5,059,851 A | * | 10/1991 | Corl et al. | 310/334 |
| 5,121,628 A | | 6/1992 | Yukishige | 73/290 V |
| 5,664,456 A | * | 9/1997 | Eckert | 73/290 V |
| 6,163,505 A | * | 12/2000 | Meier et al. | 367/165 |

FOREIGN PATENT DOCUMENTS

| | | |
|---|---|---|
| DE | 34 41 684 A | 5/1986 |
| DE | 41 14 180 A1 | 11/1992 |
| DE | 37 21 209 C2 | 4/1997 |
| EP | 0 075 302 B1 | 7/1985 |
| EP | 0 477 575 A | 4/1992 |
| FR | 2 530 108 A | 1/1984 |

OTHER PUBLICATIONS

"A Temperature compensated ultrasonic sensor operating in air for distance and proximity measurements" by Claudio Canali Et Al, IEEE 1982, pp. 336–341.

* cited by examiner

*Primary Examiner*—Hezron Williams
*Assistant Examiner*—Rose M. Miller
(74) *Attorney, Agent, or Firm*—Michael J. Striker

(57) ABSTRACT

An ultrasonic transducer has a pot-like housing with an annular wall and with a bottom surface serving as diaphragm. A piezo-element which is connected with connection lines is arranged at the inner side of the bottom surface. The edge remote of the bottom surface is surrounded by a decoupling ring which is formed as a holder for the connection lines.

7 Claims, 3 Drawing Sheets

ULTRASONIC TRANSDUCER

BACKGROUND OF THE INVENTION

The invention is based on an ultrasonic transducer with a pot-like housing with an annular wall and with a bottom surface as a diaphragm, a piezo-element which is connected with connection lines being arranged at the inner side of the bottom surface.

An ultrasonic transducer having a pot-shaped housing is known from EP 0 075 302 B1. Ultrasonic transducers of this type are used, for example, as sensors for distance measuring devices.

SUMMARY OF THE INVENTION

It is the object of the present invention to suggest an ultrasonic transducer with stable contacting suitable to mounting.

This object is met in the ultrasonic transducer according to the invention in that the edge remote of the bottom surface is surrounded by a decoupling ring and in that the decoupling ring is formed as a holder for the connection lines.

In a first advantageous embodiment form of the ultrasonic transducer according to the invention, the decoupling ring substantially fills the housing and is provided with bore holes for holding the connection lines.

In a second embodiment form, the decoupling ring has a central opening and grooves are arranged at the edge of the latter for holding the connection lines. In this case, it is advantageous when a portion of the interior of the housing not occupied by the decoupling ring, including the central opening, is filled with a damping material.

An advantageous construction of the ultrasonic transducer according to the invention consists in that the connection lines are constructed so as to be flexible. Nevertheless, due to the holding of the flexible connection lines, which are formed by cords, for example, it is possible to mount the ultrasonic transducer according to the invention on a printed circuit board in a simple manner, and the connection lines fit through the holder into the bore holes which are arranged in the respective grid dimensions provided.

In another advantageous construction of the ultrasonic transducer according to the invention, the connection lines held in the decoupling ring are constructed so as to be rigid and are connected with the piezo-element via flexible sections of line. Simple mounting is likewise ensured in this case. In this construction, it is preferably provided that the decoupling ring, besides the bore holes for holding the connection lines, also has an opening and that the opening and a portion of the interior of the housing not occupied by the decoupling ring are filled with a damping material. In this construction, the rigid connection lines can be guided out in a straight manner or can be bent outside the housing by 90°.

In order to accurately maintain the position of the connection lines and their spacing in spite of the elastic characteristics of the decoupling ring, it can be provided according to a further development that the connection lines are held at the surface of the decoupling ring by a crosspiece or web which is preferably ring-shaped.

Embodiment examples of the invention are shown in the drawing in several Figures and described more fully in the following description.

DESCRIPTION OF PREFERRED EMBODIMENTS

Figure 1A:
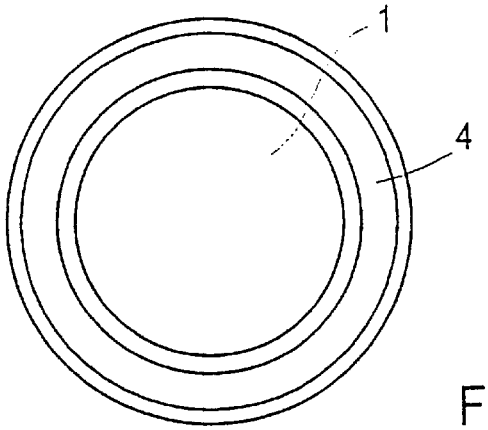
FIG. 1 shows a first embodiment example in four views.
Figure 1C:
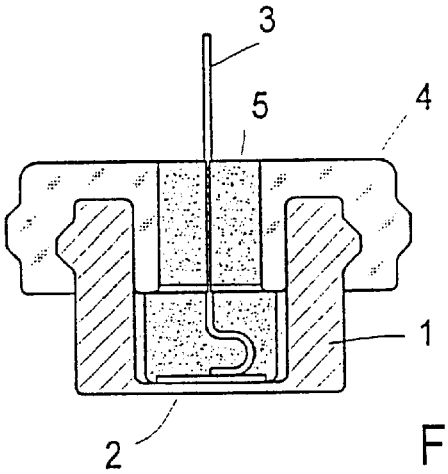
Figure 1D:
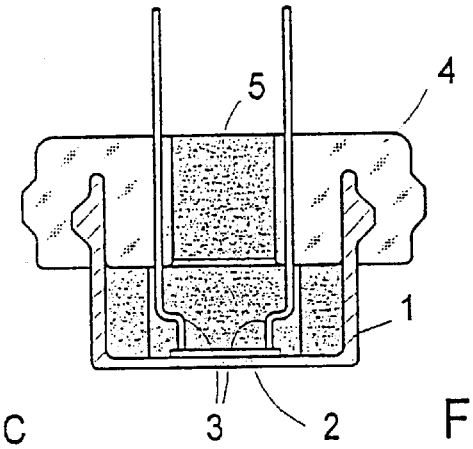
Figure 1B:
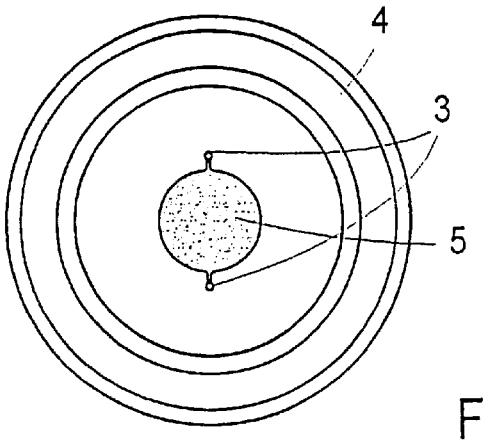
Figure 2A:
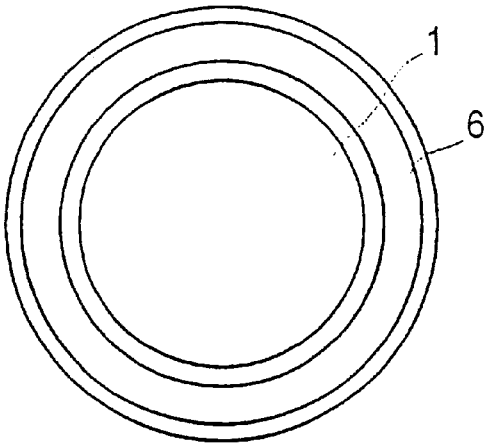
FIG. 2 shows a second embodiment example in four views.
Figure 2C:
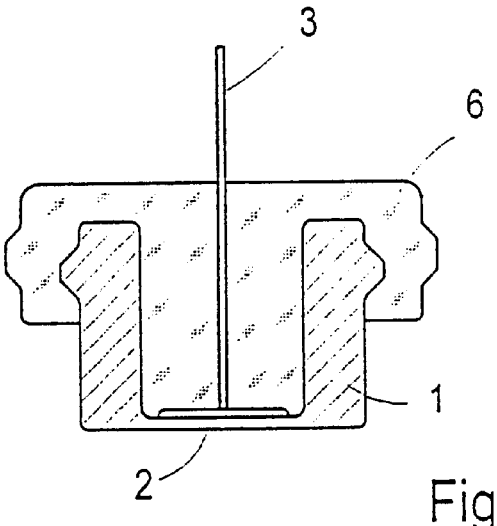
Figure 2D:
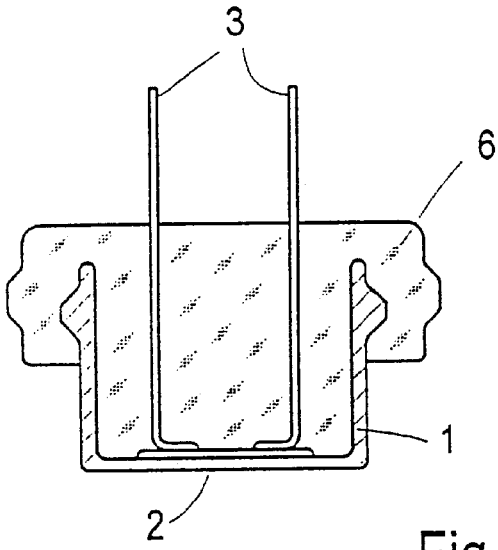
Figure 2B:
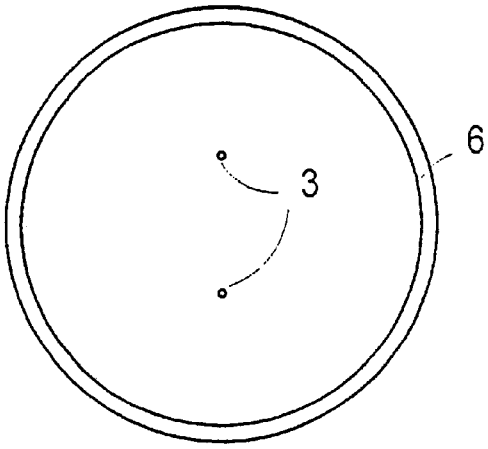

Identical parts are provided with identical reference numbers in the Figures. The Figures show the embodiment examples considered from the radiating direction or reception direction (a), in a top view from the connection side (b) and in longitudinal section (c) and (d).

Each of the embodiment examples shown in the drawings contains a sensor transducer pot 1 which is made of aluminum, the piezo-element 2 being fastened, for example, glued in, on the inner side of the bottom of the sensor transducer pot 1. A decoupling ring 4, 6, 9 is provided for the purpose of mounting the ultrasonic transducer in a stationary part, for example, in a part of a motor vehicle body, this decoupling ring 4, 6, 9 being made of elastic material, preferably silicone, and embracing the edge of the transducer pot 1. A corresponding contour of the transducer pot 1 and on the outer side of the decoupling ring 4, 6, 9 serves for secure fastening simply by pressing into a corresponding opening of the body part, not shown.

In the embodiment example according to FIG. 1, connection cords 3 contact the piezo-element 2. The decoupling ring 4 comprises a central opening whose edge is provided with grooves for holding the connection cords 3. The remaining hollow spaces are filled up with a damping material 5, for example, foamed silicone.

In the embodiment example according to FIG. 2, the decoupling ring 6 is formed in such a way that it occupies the entire interior space of the sensor pot 1. A bore hole running through the entire decoupling ring 6 is provided for the connection cords 3.

Figure 3A:
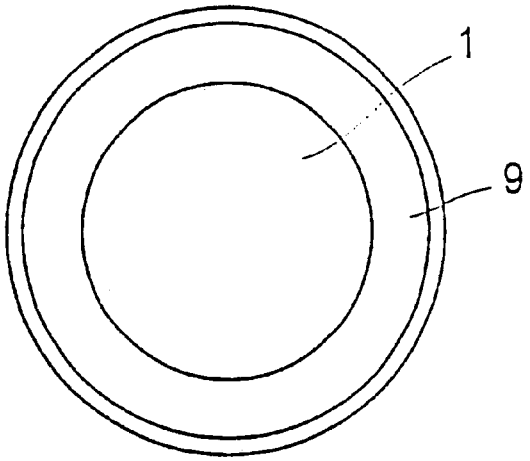
FIG. 3 shows a third embodiment example in three views.
Figure 3C:
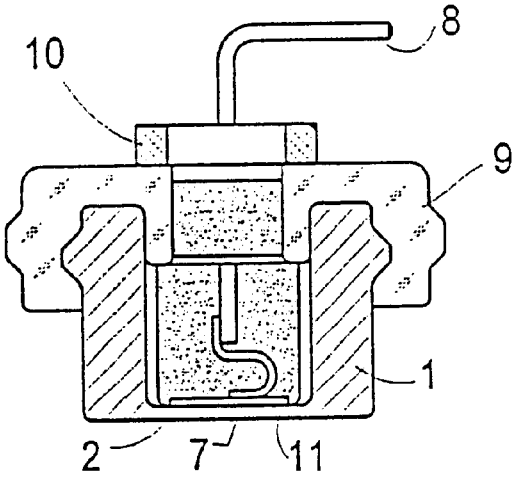
Figure 3B:
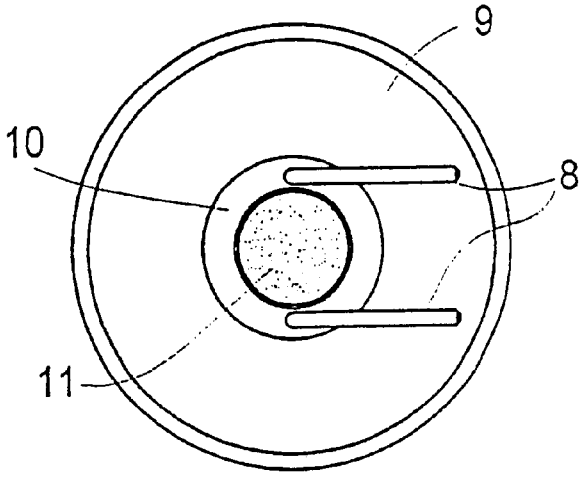

In the embodiment example according to FIG. 3, two rigid connection lines 4 are provided, each being connected with the piezo-element 2 via a flexible line 7. The rigid connection lines 8 are in turn held in the decoupling ring 9; an additional web 10 made of a material with low elasticity additionally fixes the connection lines 8 in position. Also, in the embodiment example according to FIG. 3, the hollow spaces are filled with a damping material 11.

What is claimed is:

1. An ultrasonic transducer having a pot-shaped housing with an annular wall and a bottom surface as a diaphragm; a piezo-element arranged at an inner side of said bottom surface and connected with connection lines; a decoupling ring surrounding an edge of said pot-shaped housing remote from said bottom surface, said decoupling ring being formed as a holder for said connection lines, said connection lines held in said decoupling ring being rigidly formed and connected with said piezo-element via flexible line sections.

2. An ultrasonic transducer as defined in claim 1, wherein said decoupling ring substantially fills said housing and is provided with bore holes for holding said connection lines.

3. An ultrasonic transducer as defined in claim 2, wherein said decoupling ring, in addition to said bore holes for holding said connection lines also has an opening, said opening and a portion of an interior of said housing not occupied by said decoupling ring being filled with a damping material.

4. An ultrasonic transducer as defined in claim 1, wherein said rigid connection lines are bent outside said housing by substantially 90°.

5. An ultrasonic transducer as defined in claim 1; and further comprising a web which holds said connection lines at a surface of said decoupling ring.

6. An ultrasonic transducer as defined in claim 5, wherein said web is ring-shaped.

7. An ultrasonic transducer as defined in claim 1, wherein said decoupling ring has a central opening and grooves arranged at an edge of said central opening for holding said connection lines.

* * * * *